United States Patent [19]

Jenks

[11] 4,308,656

[45] Jan. 5, 1982

[54] METHOD OF MAKING INTERNALLY SLITTED STRIP MATERIAL

[75] Inventor: Richard H. Jenks, Sauquoit, N.Y.

[73] Assignee: Revere Copper and Brass Incorporated, New York, N.Y.

[21] Appl. No.: 48,269

[22] Filed: Jun. 13, 1979

[51] Int. Cl.[3] ..... B22D 11/126

[52] U.S. Cl. ..... 29/527.7; 29/157.3 V; 164/14; 164/72

[58] Field of Search ..... 29/527.7, 157.3 V, 523, 29/521, 157.3 C; 165/183, 151, 133; 164/13, 72, 85

[56] References Cited

U.S. PATENT DOCUMENTS

| | | | |
|---|---|---|---|
| 2,983,994 | 5/1961 | Johnson | 29/527.7 X |
| 3,036,369 | 5/1962 | Wilkins | 29/527.7 X |
| 3,046,652 | 7/1962 | Wilkins | 29/527.7 |
| 3,105,296 | 10/1963 | Brick et al. | 29/527.7 X |

FOREIGN PATENT DOCUMENTS

| | | | |
|---|---|---|---|
| 209864 | 8/1957 | Australia | 29/527.7 |

*Primary Examiner*—Nicholas P. Godici
*Assistant Examiner*—V. K. Rising
*Attorney, Agent, or Firm*—Carella, Bain, Gilfillan & Rhodes

[57] ABSTRACT

An improved method of making internally slitted strip material wherein a metal billet is cast about friable elongated members of weld preventing material and wherein the billet and elongated members are rolled to thin and elongate the billet and to pulverize the weld preventing material into a fine weld preventing powder for distribution along the spaces occupied by the weld preventing material and which spaces upon the pulverized weld preventing powder being removed form the slits, the improvement wherein prior to casting the metal billet about the elongated members of weld preventing material, the friability of the weld preventing member is enhanced to cause the members to pulverize more evenly and to distribute more evenly along the spaces occupied by the pulverized weld preventing material whereby any tendency of the pulverized powder to leave gaps at which welds are formed during rolling is substantially eliminated and wherein such enhancement is provided by coating the elongated members with a predetermined composition which produces the enhanced friability and which coating also substantially eliminates any intimate contact between the weld preventing members and the metal billet whereby substantially no residue of the weld preventing powder remains on the walls of the slits and hence any tendency of such residue to cause corrosion by galvanic action upon certain fluid flowing through the slits is substantially eliminated.

11 Claims, 2 Drawing Figures

PRIOR ART
FIG. 1
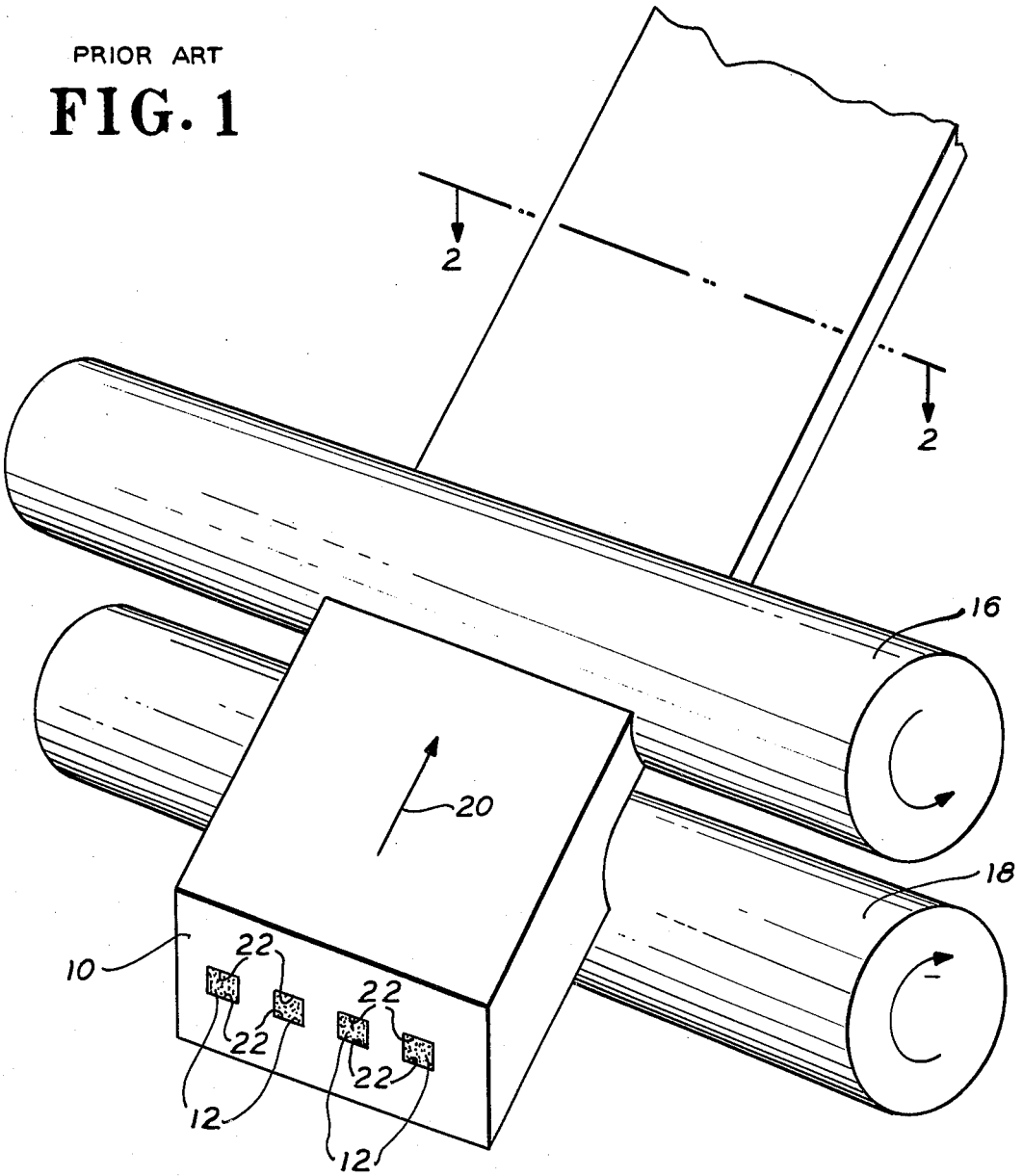
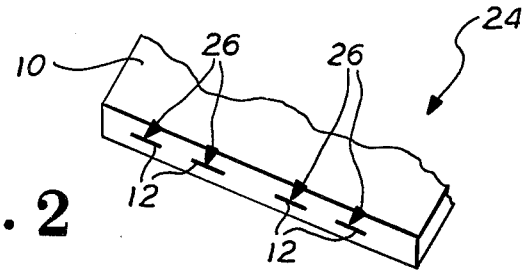
FIG. 2

METHOD OF MAKING INTERNALLY SLITTED STRIP MATERIAL

BACKGROUND OF THE INVENTION

This invention relates generally to improved methods of making internally slitted strip material, and in particular, relates to improved methods of making internally slitted strip material wherein the below noted prior art problems of intermittent welds or interrupted slits and corrosion are overcome. Such internally slitted strip material being particularly useful in refrigerating and other heat exchange apparatus.

DESCRIPTION OF THE DRAWINGS

FIG. 1 is a diagrammatic illustration of a typical prior art method of making internally slitted strip material of which the present invention is an improvement; and FIG. 2 is a cross-sectional view taken along the line 2—2 in FIG. 1 in the direction of the arrows.

DESCRIPTION OF THE PRIOR ART

As is known to those skilled in the art of making internally slitted strip material, many prior art methods are known which have performed reasonably satisfactorily with generally acceptable yields, however, such prior art methods have the continuing problems of slit interruptions due to intermittent welds and corrosion as will be taught in detail below.

Referring now to FIG. 1 for a general background and understanding of the prior art and the above-noted prior art problems, a metal billet 10 is cast about friable elongated members of weld preventing material 12 of flattened transverse cross-section of the widths of the longitudinal slits to be formed in the strip material. The metal billet 10 and elongated members of weld preventing material 12 are rolled by being passed between opposed rollers 16 and 18 to thin and elongate the billet in the direction of the arrow 20 and to pulverize the weld preventing material 12 into a fine weld preventing powder distributed along the spaces occupied by the pulverized weld preventing material and the slits being formed. The purpose of the weld preventing material, as its name states, is to prevent welds or bonds from being formed during rolling between the opposed walls 22 (FIG. 1) forming the slits as such opposed walls are formed towards each other during rolling.

As shown in FIG. 2, the rolled metal billet 10 has been thinned and elongated to form internally slitted strip material indicated by general numerical designation 24 and the weld preventing material 12 has been pulverized to a powder and reduced in thickness to the desired thickness of the slits to be formed. The pulverized weld preventing powder occupies the spaces which will form the slits indicated by general numerical designation 26 upon removal of the pulverized weld preventing powder.

Referring again to the above-noted prior art problems, it has been found that upon rolling and pulverization of the weld preventing material 12, pulverization is not always uniform or homogeneous and that even or uniform axial flow or distribution of the pulverized weld preventing material does not always occur along the longitudinal spaces which will form the slits 26. Failure of the weld preventing material to pulverize evenly and distribute evenly along the spaces forming the slits 26 causes interruptions or gaps in the pulverized weld preventing powder and upon rolling the opposed walls 22 (FIG. 1) are forced together to form intermittent welds or bonds at such gaps. As is further known to those skilled in the art, such intermittent welds cause uncorrectable defects rendering the internally slitted strip material unusable and useful only for recycling of the metal.

With further regard to the prior art and referring again to FIG. 2, the pulverized weld preventing material or powder 12 is removed from the elongated and thinned billet 10 by forcing pressurized fluid through the slits 26 and/or by scouring the slits by forcing an abrasive slurry under pressure through the slits. While such removal steps are generally satisfactory, it is frequently found that a residue of the weld preventing powder remains in the slits and with the result that when the fluid flowing through the slits is of an acidic nature and the metal billet is for example copper or a copper-based alloy and the weld preventing material is, for example, carbon, the carbon residue is cathodic with respect to the copper billet and hence there is a tendency of the metal to corrode by galvanic action during use due to the presence of the carbon residue. Such galvanic action unduly shortens the life of the internally slitted strip material and has provided a continuing problem.

DESCRIPTION OF THE PREFERRED EMBODIMENT

It has been discovered that the friability characteristic of elongated members of weld preventing material 12, i.e. the characteristic of the weld preventing material to pulverize upon rolling, can be unexpectedly enhanced and that the distribution or axial flow characteristic of the pulverized weld preventing material can be unexpectedly enhanced by coating the outer longitudinally extending surfaces of the weld preventing material with a thin layer of a predetermined composition, prior to casting, in accordance with the teachings of the present invention.

In particular, it has been discovered that if, prior to casting, at least the outer peripheral portions of the elongated members of weld preventing material 12 are chemically reacted with a predetermined composition according to the teachings of the present invention, a thin coating is formed on the outer surfaces of the weld preventing material which coating causes the weld preventing material to pulverize more homogeneously or evenly and distribute or flow axially more evenly upon rolling and hence, the noted prior art gap and intermittent weld problem is substantially eliminated.

More specifically, it has been found that such coating may be formed by applying to the outer surfaces of the weld preventing material a coating in the range of 0.005–0.015 inch thick of a composition comprised by percent weight of borax 0.009%, bentonite 1.24%, Florida clay 4.3%, spar 46.4%, zinc oxide 3.0%, flint 15.5%, whiting 16.7%, and ULTROX 11.9%, and by heating the coated material in a reducing atmosphere at a temperature in the range of 2200° F.–2600° F. for a period of time in the range from 6 to 10 hours.

The thin layer of the composition may be applied to the outer longitudinally extending surfaces of the elongated members of weld preventing material 12 such as by spraying or dipping.

It will be further understood by those skilled in the art that the thickness of the coating formed on the elongated members of weld preventing material 12, or the depth to which the chemical reaction between the composition and the weld preventing material penetrates inwardly of the outer peripheral portion of the weld preventing material, depends upon whether the chemical reaction is practiced once or repeatedly, the temperature at which the reaction is produced and the period of time at which the heating occurs. Thus the thickness of the formed coating can be suitably controlled.

It has been further unexpectedly found that the coating formed on the weld preventing material 12 in accordance with the above teachings of the present invention produces the unexpected result of preventing intimate contact between the billet and the weld preventing material whereby upon the removal of the pulverized weld preventing material or powder 12 from the slits 26, substantially no residue of the pulverized material remains on the walls of the slits and the above-noted corrosion problem due to galvanic action is substantially eliminated.

Since, as is further known to those skilled in the prior art, the metal of which the internally slitted strip material is formed may be, for example, aluminum, brass, copper or their various alloys, and since the weld preventing material used may be, for example, carbon or its various compounds, crystalline carbon or graphite, various minerals such as amethyst, the degree to which the prior art problem of corrosion is present will vary depending upon the specific metal, or metal alloy, used and the specific material of the weld preventing material used. Further, the prior art problem of gaps or intermittent welds can also be present to varying degrees depending upon the metal and weld preventing material used. Accordingly, it will be understood that it is within the scope of the present invention to form the coating on the weld preventing material for the dual purpose of solving both prior art problems of gaps and corrosion and for the sole purpose of solving each separately.

With regard to the above-taught coating composition constituent "ULTROX," it will be understood that "ULTROX" is the trademark or brand name of the M & T Chemical Co. of Rahway, N.J. and that "ULTROX" can be obtained from such company or its distributors.

It will be further understood by those skilled in the art that many modifications and variations of the present invention may be made without departing from the spirit and the scope thereof.

What is claimed is:

1. In the method of making internally slitted strip material including the steps of casting a metal billet about friable elongated members of weld preventing material of flattened transverse cross-section of the widths of the slits to be formed in the strip material, rolling the billet and the elongated members of weld preventing material to thin and elongate the billet in the direction of rolling and to pulverize the weld preventing material into a fine weld preventing powder for distribution along the spaces occupied by the weld preventing material and which spaces upon the removal of the pulverized weld preventing material form said slits, and wherein upon said removal of said pulverized weld preventing material a residue thereof remains on the walls of said slits which residue is cathodic with respect to said metal billet whereby upon certain fluids flowing through said slits said residue causes corrosion of said internally slitted strip material due to galvanic action, wherein the improvement comprises the steps of:

prior to casting said metal billet about said elongated members of weld preventing material, coating the outer longitudinally extending surfaces of said elongated members of weld preventing material by applying to said outer surfaces of said weld preventing material a coating in the range of 0.005–0.015 inch thick of a composition comprised by percent weight of borax 0.009%, bentonite 1.24%, Florida clay 4.3%, spar 46.4%, zinc oxide 3.0%, flint 15.5%, whiting 16.7%, ULTROX 11.9%, heating said coated material in a reducing atmosphere at a temperature in the range of 2200° F.–2600° F. for a period of time in the range of 6 to 10 hours, to cause said weld preventing material upon said rolling: (i) to pulverize more evenly and to distribute more evenly along said spaces occupied by the slits being formed thereby reducing any tendency of the pulverized weld preventing material to leave gaps at which welds are formed upon said rolling, and (ii) to prevent intimate contact between said walls of said slits and said elongated members of weld preventing material whereby upon said removal of said pulverized weld preventing material from said slits substantially no residue of said pulverized material remains on the walls of said slits and said corrosion is substantially eliminated.

2. In the method according to claim 1 wherein said recited steps are repeated a predetermined number of times.

3. In the method of making internally slitted strip material including the steps of casting a metal billet about friable elongated members of weld preventing material of flattened transverse cross-section of the widths of the slits to be formed in the strip material, rolling the billet and the elongated members of weld preventing material to thin and elongate the billet in the direction of rolling and to pulverize the weld preventing material into a fine weld preventing powder for distribution along the spaces occupied by the weld preventing material and which spaces upon the pulverized weld preventing material being removed from said slits, and wherein upon said weld preventing material upon pulverization having a tendency not to distribute evenly whereby gaps are formed therein at which welds between the walls of said slits are formed during rolling, wherein the improvement comprises the steps of:

prior to casting said metal billet about said elongated members of weld preventing material, enhancing the friability of said weld preventing material by coating the outer longitudinally extending surfaces of said material with a thin layer of a predetermined composition by chemically reacting at least the outer peripheral portions of said elongated members of weld preventing material with said predetermined composition to cause said weld preventing material upon said rolling to pulverize more evenly and thereby distribute more evenly along said spaces occupied by the slits being formed thereby reducing said tendency of the pulverized weld preventing material to form said gaps at which said welds are formed during rolling.

4. In the method according to claim 3 wherein said step of chemically reacting is accomplished by applying to said outer surfaces of said elongated members of weld preventing material a coating of said predetermined composition of a predetermined thickness, and heating said coated weld preventing material in a reducing atmosphere at a predetermined temperature and for a predetermined period of time.

5. In the method according to claim 3 wherein said step of chemically reacting at least the outer peripheral portions of said elongated members of weld preventing material with said predetermined composition is accomplished by the steps of applying to said outer surfaces of said weld preventing material a coating in the range of 0.005–0.015 inch thick of a composition comprised by percent weight of borax 0.009%, bentonite 1.24%, Florida clay 4.3%, spar 46.4%, zinc oxide 3.0%, flint 15.5%, whiting 16.7%, ULTROX 11.9%; heating said coated material in a reducing atmosphere at a temperature in the range of 2200° F.–2600° F. and for a period of time in the range of 6 to 10 hours.

6. In the method according to claim 5 wherein said recited steps are repeated a predetermined number of times.

7. In the method of making internally slitted strip material including the steps of casting a billet of copper-base alloy about elongated carbon rods of flattened transverse cross-section of the widths of the slits to be formed in the strip material, rolling the cast billet and carbon rods to thin and elongate the billet in the direction of rolling and to pulverize the carbon rods into a fine weld preventing powder for distribution along the spaces occupied by said pulverized weld preventing material and which spaces upon the removal of said pulverized weld preventing material form said slits, and wherein said carbon rods upon said pulverization have a tendency not to distribute evenly and to form gaps at which welds are formed between the walls of said slits during rolling, wherein the improvement comprises the step of:

prior to casting said billet of copper-based alloy about said elongated carbon rods, enhancing the friability of said carbon rods by chemically reacting at least the outer peripheral portions of said carbon rods with a predetermined composition by the steps of coating said outer surfaces of carbon rods with a coating of said predetermined composition of a predetermined thickness and heating said coated carbon rods in a reducing atmosphere at a predetermined temperature for a predetermined period of time to cause said rods upon said rolling to pulverize more evenly and to distribute more evenly along said spaces forming said slits thereby reducing said tendency of the pulverized weld preventing powder to leave said gaps and thereby substantially eliminating said welds.

8. In the method according to claim 7 wherein said chemically reacting at least the outer peripheral portions of said carbon rods with said predetermined composition is accomplished by the steps of applying to the outer surfaces of said carbon rods a coating in the range of 0.005–0.015 inch thick of a composition comprised by percent weight of borax 0.009%, bentonite 1.24%, Florida clay 4.3%, spar 46.4%, zinc oxide 3.0%, flint 15.5%, whiting 16.7%, ULTROX 11.9%; and heating said coated material in a reducing atmosphere at a temperature in the range of 2200° F.–2600° F. and for a period of time in the range of 6 to 10 hours.

9. In the method according to claim 8 wherein said recited steps are repeated a predetermined number of times.

10. In the method of making internally slitted strip material including the steps of casting a metal billet about friable elongated members of weld preventing material of flattened transverse cross-section of the widths of the slits to be formed in the strip material, rolling the billet and the elongated members of weld preventing material to thin and elongate the billet in the direction of rolling and to pulverize the weld preventing material into a fine weld preventing powder distributed along the spaces occupied by the weld preventing material, and removing the pulverized weld preventing powder from said spaces to form said slits, and wherein upon the removal of said weld preventing powder a residue thereof remains on the walls of said slits and which residue is cathodic with respect to said metal billet whereby upon certain fluids flowing through said slits said residue causes corrosion of said internally slitted strip material due to galvanic action, wherein the improvement comprises:

prior to casting said metal billet about said elongated members of weld preventing material, coating the outer longitudinally extending surfaces of said elongated members of weld preventing material by the steps of applying to said outer surfaces a coating in the range of 0.005–0.015 inch thick of a composition comprised by percent weight of borax 0.009%, bentonite 1.24%, Florida clay 4.3%, spar 46.4%, zinc oxide 3.0%, flint 15.5%, whiting 16.7%, ULTROX 11.9%, heating said coated material in a reducing atmosphere at a temperature in the range of 2200° F.–2600° F. for a period of time in the range of 6 to 10 hours, to prevent intimate contact between said walls of said slits and said elongated members of weld preventing material whereby upon said removal of said pulverized weld preventing material from said slits substantially no residue of said pulverized material remains on the walls of said slits and said corrosion is substantially eliminated.

11. In the method according to claim 10 wherein said recited steps are repeated a predetermined number of times.

* * * * *